US010913581B2

(12) United States Patent
Stahlecker

(10) Patent No.: US 10,913,581 B2
(45) Date of Patent: Feb. 9, 2021

(54) MULTIPART COVER MADE OF PAPER AND METHOD FOR PRODUCING A COVER

(71) Applicant: Werner Stahlecker, Goeppingen (DE)

(72) Inventor: Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 1152 days.

(21) Appl. No.: 14/719,876

(22) Filed: May 22, 2015

(65) Prior Publication Data

US 2015/0251821 A1 Sep. 10, 2015

Related U.S. Application Data

(62) Division of application No. 13/845,523, filed on Mar. 18, 2013, now abandoned.

(Continued)

(30) Foreign Application Priority Data

Sep. 18, 2012 (DE) ..... 10 2012 216 629

(51) Int. Cl.
*B65D 43/02* (2006.01)
*B65D 45/32* (2006.01)

(52) U.S. Cl.
CPC ..... *B65D 43/0212* (2013.01); *B65D 45/32* (2013.01); *B65D 2543/0024* (2013.01);

(Continued)

(58) Field of Classification Search
CPC ..... B65D 2543/00027; B65D 2543/00092; B65D 2543/0037; B65D 2543/00796;

(Continued)

(56) References Cited

U.S. PATENT DOCUMENTS 2,069,213 A * 2/1937 Carew ..... B65D 43/0212 229/125.25
2,141,447 A * 12/1938 Price ..... B65D 3/12 229/125.19

(Continued)

FOREIGN PATENT DOCUMENTS

CN 101005995 A 7/2007
CN 101356097 A 1/2009

(Continued)

OTHER PUBLICATIONS

English translation of an Office Action of the Chinese Patent Office issued in Application No. 201310232922.0, dated Oct. 18, 2016 (12 pages).

(Continued)

*Primary Examiner* — Anthony D Stashick
*Assistant Examiner* — James M Van Buskirk
(74) *Attorney, Agent, or Firm* — Flynn Thiel, P.C.

(57) ABSTRACT

A multipart cover made of paper material and including a base body having a cover plate and a circumferential cover collar extending from the cover plate, wherein the cover collar, in a condition where same is placed onto a vessel to be closed, surrounds an upper rim of a vessel to be closed, and a reinforcement ring surrounds the cover collar at least sectionally on the radially exterior side of the cover collar. The cover collar includes at least one bead encircling the cover collar in the circumferential direction, and when viewed in the elevation direction the bead is disposed at a constant distance from the cover plate.

20 Claims, 11 Drawing Sheets

Related U.S. Application Data

(60) Provisional application No. 61/659,203, filed on Jun. 13, 2012.

(52) U.S. Cl.
CPC ..... *B65D 2543/00027* (2013.01); *B65D 2543/0037* (2013.01); *B65D 2543/00092* (2013.01); *B65D 2543/00268* (2013.01); *B65D 2543/00537* (2013.01); *B65D 2543/00629* (2013.01); *B65D 2543/00685* (2013.01); *B65D 2543/00731* (2013.01); *B65D 2543/00796* (2013.01)

(58) Field of Classification Search
CPC .. B65D 2543/0024; B65D 2543/00268; B65D 2543/00629; B65D 2543/00685; B65D 2543/00731; B65D 2543/00537; B65D 43/0212; B65D 45/32
USPC ..... 220/319, 359.3, 359.2, 359.1, 806, 796, 220/782, 795, 780; 229/125.25, 5.5, 229/123.2, 404; 215/274
See application file for complete search history.

(56) References Cited

U.S. PATENT DOCUMENTS

| | | | | |
|---|---|---|---|---|
| 3,179,283 | A * | 4/1965 | Amberg | B65D 43/0212 206/515 |
| 3,452,921 | A * | 7/1969 | Donovan | B65D 43/0218 229/123.2 |
| 3,883,036 | A | 5/1975 | Mahaffy et al. | |
| 4,275,815 | A | 6/1981 | Davis | |
| 5,385,255 | A | 1/1995 | Varano et al. | |
| 5,960,986 | A | 10/1999 | Nielsen et al. | |
| 7,100,790 | B2 | 9/2006 | Dark | |
| 8,118,187 | B2 | 2/2012 | D'Amato | |
| 2004/0232154 | A1 * | 11/2004 | Smith | A47G 19/2211 220/713 |
| 2008/0099481 | A1 | 5/2008 | D'Amato | |
| 2009/0159606 | A1 | 6/2009 | D'Amato | |
| 2010/0140282 | A1 * | 6/2010 | Steg | B65D 43/0212 220/780 |
| 2010/0176130 | A1 * | 7/2010 | Kim | B65D 43/0212 220/254.1 |
| 2010/0252555 | A1 * | 10/2010 | Syed | B65D 3/06 220/212 |

FOREIGN PATENT DOCUMENTS

| | | |
|---|---|---|
| DE | 44 29 057 A1 | 2/1996 |
| JP | 2004-189253 | 7/2004 |

OTHER PUBLICATIONS

English translation of Office Action of Chinese Patent Office issued in Application No. 201310232922.0 dated Feb. 15, 2016 (14 pages).
Search Report of European Patent Office issued in European Application No. EP 13 16 9585 with English translation of category of cited documents dated Sep. 26, 2013 (7 pages).

* cited by examiner 120
120
120
124
132
130
136
136

120
128
122
134
26
16
124
132
136
130

120
16

120
120
120

120
124
16
122

170
182
186
190

170
178
172
174
180

170
174
172
176

170
178
172
186
174
184
176
180
182

190
170
170

MULTIPART COVER MADE OF PAPER AND METHOD FOR PRODUCING A COVER

CROSS REFERENCE TO RELATED APPLICATION

This is a divisional of prior U.S. application Ser. No. 13/845,523, filed Mar. 18, 2013, which claims the benefit of U.S. Provisional Application No. 61/659,203, filed Jun. 13, 2012.

BACKGROUND OF THE INVENTION

The invention relates to a multipart cover made of paper material. The invention also relates to a method for producing a multipart cover made of paper material.

The aim of the invention is to provide an improved multipart cover made of paper material and an improved method for producing such a cover.

According to the invention a multipart cover made of paper material is provided, comprising a base body which includes a cover plate and a circumferential cover collar extending from the cover plate, wherein the cover collar, in a condition placed onto a container to be closed, surrounds an upper rim of a container to be closed, and a reinforcement ring which surrounds the cover collar at least sectionally on the radially exterior side of the cover collar.

In a further development of the invention, the cover collar includes at least one bead encircling the cover collar in the circumferential direction, wherein viewed in the elevation direction the bead is disposed at a constant distance to the cover plate.

With the base body including a circumferential cover collar surrounding an upper rim of a container to be closed, the circumferential cover collar is configured to be continuous and without a step, since the base body is in one piece. Thus, the cover according to the invention sits specifically tight on a cup to be closed, since the base body formed in one piece does not have an overlapping to present a step that could affect leak tightness.

By means of the cover according to the invention, a secure hold of the cover on the container to be closed is ensured in that the bead engages behind a circumferential lip rim, that may also be flattened, of the container to be closed, for example a cardboard cup. Here, the distance of the bead to the cover plate is matched to the height of the lip rim of the container to be closed. Since the cover collar and the cover plate are shaped from a one-piece paper cut-out, the cover collar does not have an overlapping and thus may apply tightly to the open end of a container to be closed. Thus, by means of the cover according to the invention, a very leak-tight closure may be obtained. In this context, paper as well as paper-type materials, like paperboard, pasteboard, cardboard, and the like are considered to be paper materials. Even coated paper material is considered to be paper material, for example, paper coated by a layer of wax or a layer of synthetic material on one side or on two sides. The coated side of the paper material can be adapted to hot sealing, to connect the base body to the reinforcement ring. Conveniently, the base body is produced from a paper material provided with a synthetic material coating at least on one side, and the coated surface is facing the open end of the container closed by the cover. The individual parts of the multipart cover according to the invention can in general be connected to another by different ways and means, by hot sealing, as mentioned, but also by adhesive bonding, using hot melt adhesive or cold glue, for example, by pressing, and also by a combination of said connecting means.

In a further development of the invention, the bead extends radially inwards relative to a portion of the cover collar immediately adjacent to the cover plate.

In this manner, when placing the cover onto a vessel to be closed, an upper rim of the vessel can snap-in behind the bead, and thus a particularly simple placement and secure hold of the cover on the container is ensured.

In a further development of the invention, a portion between the bead and the cover plate is configured to be curved radially outwards, as viewed in cross section.

Such a design of the cover is particularly advantageous in case that the container to be closed has a lip rim of circular cross section at the upper, open end thereof. Said lip rim can then be received in the portion between the bead and the cover plate and a particularly secure and leak-tight closure of the vessel may be obtained. Therein, the portion between the bead and the cover plate may be configured to have a cross section in the shape of a circle segment, to allow receiving of a lip rim of circular cross section. However, the portion between the bead and the cover plate can also be in an oval shape, and thus be provided for a lip rim of circular cross section or even a flattened lip rim. For example, a cup can have a peripheral, flattened foldover or simply a horizontal radially outwards projecting rim at the upper rim of the cup. Such a rim can as well be securely received with a radially outwards curved portion between the bead and the cover plate, and such a rim is as well referred to as a lip rim.

In a further development of the invention, a portion of the cover plate, immediately adjacent to the cover collar, is curved outwards as viewed in cross section, and extends, starting from the transition between cover collar and cover plate, downwards towards the open side of the cover.

Such a design allows receiving of a lip rim of a vessel to be closed over a very wide range of angles, as viewed in cross section. Thus, the vessel can be securely closed. For example, the transition between cover collar and cover plate is rounded out over an angle of more than 90°, as viewed in cross section. The rounding out can extend up to 180° at the transition between cover collar and cover plate.

In a further development of the invention, the cover collar is configured in the shape of a truncated cone in the direction towards the open side of the cover, successive to the bead up to the lower rim of the cover.

Such a design of the cover collar facilitates sliding the cover onto the upper rim of a container to be closed and provides for self-centering of the cover during sliding on, for example. By means of such a design of the cover collar, stacking of the covers is also substantially facilitated.

In a further development of the invention, a portion of the reinforcement ring disposed above the cover bottom has an outer diameter that is smaller than an inner diameter of the cover collar below the bead, and an inner diameter of the bead is smaller than the outer diameter of the reinforcement ring above the cover bottom.

In this manner, multiple covers according to the invention can be stacked securely, and even in case that multiple covers according to the invention are stacked, there is no risk that the stacked covers get jammed into another, since the bead is to prevent that two stacked covers are inserted too far one into the other and thus are jammed.

In a further development of the invention, the bead extends radially outwards relative to a portion of the cover collar immediately adjacent to the cover plate.

In this manner, the bead can receive a lip rim of a container to be closed, and thus provide for secure locking of the cover on the container.

In a further development of the invention, the reinforcement ring on an upper surface of the cover bottom is provided with a roll ring extending over the periphery of the cover and having an essentially circular cross section.

Such a roll ring is for stiffening the cover, wherein the roll ring may rest on the cover plate, to further increase the reinforcing effect. The roll ring may also be a support surface for stacking multiple cups.

In a further development of the invention, the roll ring rests on the upper surface of the cover bottom.

In this manner, the reinforcing effect of the roll ring may be even further improved.

In a further development of the invention, the reinforcement ring on an upper surface of the cover bottom is provided with a peripheral shroud or skirt.

Such a skirt is for stiffening of the cover and can be configured to be cylindrical or a truncated cone tapering to the upper side. The term shroud or skirt is to designate an edge crimped and pressed by 180°. Such a shroud allows a very stiff configuration of the multipart cover according to the invention.

In a further development of the invention, the skirt is configured to be cylindrical.

In a further development of the invention, the skirt is configured to be a truncated cone.

A truncated cone tapering to the upper side configuration of the skirt facilitates stacking of multiple covers.

In a further development of the invention, the reinforcement ring rests planar on a periphery of the cover collar.

A planar resting of the reinforcement ring on a periphery of the cover collar provides for a secure connection and a very stable implementation of the cover according to the invention.

In a further development of the invention, the reinforcement ring has a bead extending radially outwards, the radially exterior upper side of which is a support surface for stacking another cover of the same type.

In this manner, multiple covers can be stacked securely, and there is no risk that during stacking the covers slide too far one into the other that they are jammed.

In a further development of the invention, a lower peripheral edge of the cover collar and/or of the reinforcement ring in the stacked condition of two similar covers rests on the support surface on the upper side of the bead.

In a further development of the invention, the reinforcement ring is connected to the cover collar by means of adhesive bonding or sealing above and below the circumferential bead extending along the periphery.

In this manner, the cover according to the invention can have a particularly stable design, and thus be produced using thinner paper material, for example.

The problem underlying the invention is also solved by a method for producing a multipart cover made of paper material, comprising the following steps:

shaping a base body from a one-piece paper material cut-out, wherein the base body includes a cover plate and a circumferential cover collar extending from the cover plate, and wherein the cover collar is provided with a circumferential bead, shaping a reinforcement ring, and connecting the reinforcement ring to the base body such that the reinforcement ring surrounds the cover collar on the radially exterior side of the cover collar.

In the process, the succession of the method steps can be varied.

BRIEF DESCRIPTION OF THE DRAWINGS

Further features and advantages of the invention will be apparent from the claims and the subsequent description of preferred embodiments of the invention in connection with the drawings. Individual features of the different embodiments illustrated and described may be combined in an arbitrary manner without departing from the scope of the present invention. In the drawings:

FIG. 19 shows a sectional view of the stacked covers of FIG. 18, FIG. 49 shows a sectional view of the stacked covers of FIG. 48.

DETAILED DESCRIPTION

Figures 1, 2, 3, 4, 5:
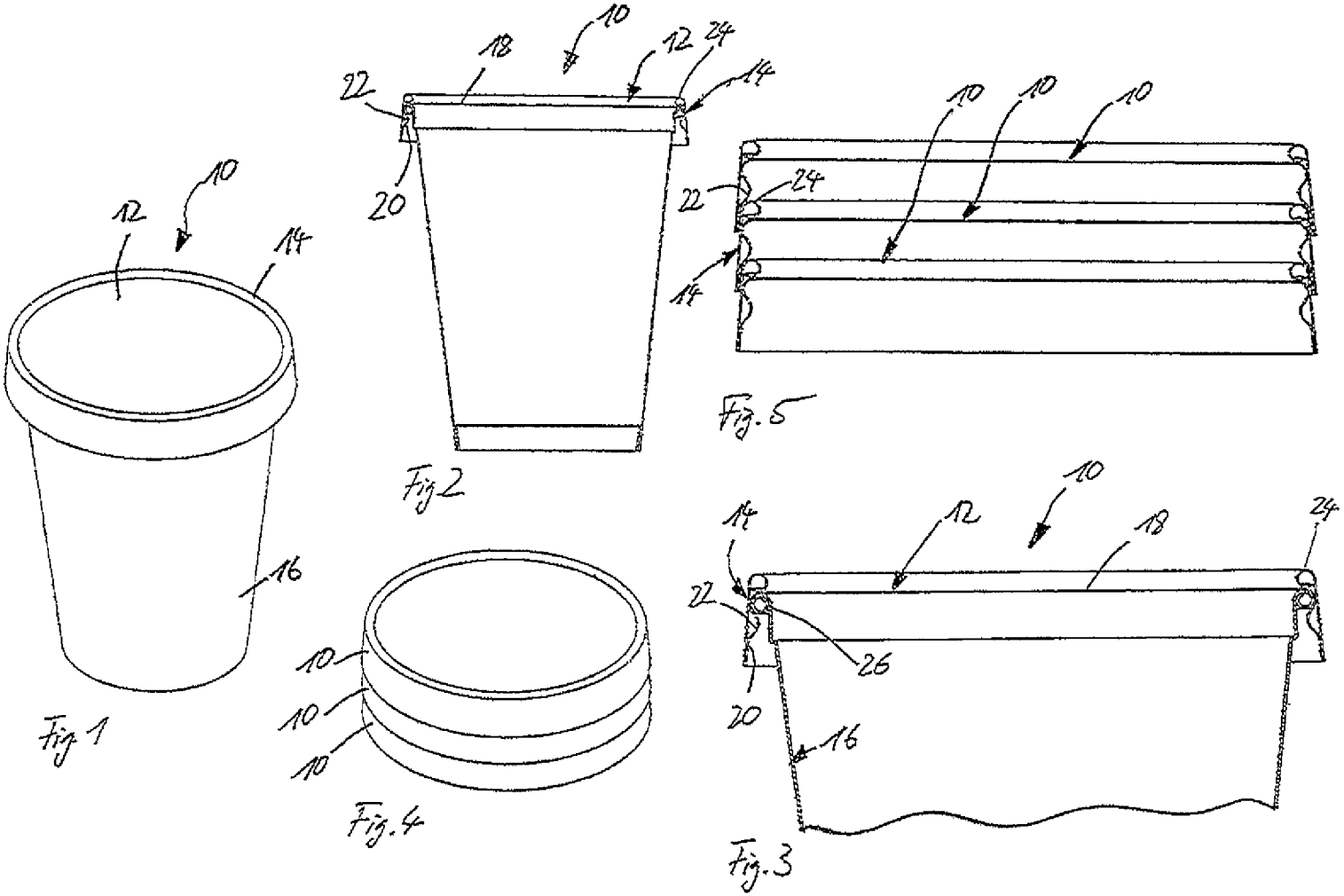
FIG. 1 shows a view of a container with a cover according to the invention placed thereon according to a first embodiment.
FIG. 2 shows the container and the cover of FIG. 1 in a sectional view.
FIG. 3 shows an enlarged detail of FIG. 2.
FIG. 4 shows a view of multiple stacked covers.
FIG. 5 shows a sectional view of the stacked covers of FIG. 4.

The illustration of FIG. 1 shows a multipart paper cover 10, comprising a base body 12 and a reinforcement ring 14 surrounding the base body 12. The cover 10 is placed onto a cup 16.

The sectional view of FIG. 2 shows that the base body 12 is produced from a one-piece paper cut-out and includes a cover plate 18 and a circumferential cover collar 20 extending from the cover plate 18. The base body 12 is produced by deforming a one-piece cut-out which is circular and is subject to deep drawing, for example, to initially produce a bowl-shaped body, with the bowl bottom then forming the cover plate and the bowl wall forming the cover collar 20. A circumferential bead 22 is realized in the cover collar 20 by appropriate dies or also by pressing in a roller encircling the cover collar 20, for example. In the embodiment of the multipart cover 10 as illustrated, the bead 22 is shaped radially inwards. The reinforcement ring 14 is then placed onto the base body 12. The reinforcement ring 14 is composed of a one-piece, strip-shaped paper cut-out that is connected in the vicinity of an overlapping (not illustrated), by adhesive bonding or sealing, for example. Before or after sliding onto the base body 12, a ring roll 24 is integrally formed at the reinforcement ring 14. The ring roll 24 rests on a top surface of the cover plate 18. The reinforcement ring 14 rests on the cover collar 20 in a region above and below the bead 20. In a region below the bead 20, then ending with the lower rim of the cover 10, and even above the bead 20, as the case may be, the reinforcement ring 14 and the cover collar 20 are interconnected, by sealing or adhesive bonding, for example.

Thus, the reinforcement ring 14 with its ring roll 24 rests, see FIG. 3, on the top surface of the cover plate 18, and furthermore rests on the radially exterior side of the cover collar 20 both above and below the bead 22 on the cover collar 20. As a consequence, the cover 10 is very stable, and in particular the bead 22 is stabilized by the reinforcement ring 14.

The cup 16 is provided, as is apparent from FIG. 2 and FIG. 3, on its upper, open end with a lip rim or lip roll 26 that has an approximately circular cross section, visible in the sectional view of FIG. 3. When the cover 10 is placed on, the circumferential bead 22 snaps in behind the lip rim or lip roll 26, and thus secures the cover 10 on the cup 16 to prevent unintentional removal.

The cover 10 allows a particularly leak-tight closure of the cup 16 in that a region between the bead 22 and the transition of the cover collar 20 to the cover plate 18 is formed with an outwards curvature. In the placed-on condition of the cover 10, an upper portion of the bead and most important the region between the bead and the cover plate 18 rests essentially planar against the lip rim 26. Thus, there is a comparatively leak-tight closure obtained between the cup 16 and the cover 10. This is also due to the fact that the cover collar 20 does not have an overlapping.

Overall, the reinforcement ring 14 is configured approximately in the shape of a truncated cone, wherein the diameter thereof is enlarging from the ring roll 24 downwards. The cover collar 20 as well follows said downwards enlarging basic shape of a truncated cone. Therefore, the cover 10 is outwards expanded in a truncated cone shape on the radially interior side of the cover collar 20 below the bead 22. As a result, when the cover 10 is placed on the lip rim 26 of the cup 16, the cover 10 is self-centering, and sliding the cover 10 on is substantially facilitated. The bead 22 is rounded in such a manner that during sliding the cover 10 on, said cover is resiliently expanded when the bead 22 slides past the lip rim 26. Upon passing the smallest diameter of the bead 22, the cover 10, and in particular the bead 22, will snap-in behind the lip rim 26, and thus lock the cover 10 on the cup 16 in a position as shown in FIG. 3.

The cover 10 is configured in an aesthetically appealing manner, since the radially exterior side of the reinforcement ring 14 has a smooth surface. Thus, said radially exterior side of the reinforcement ring 14 can be provided with a high-grade printing and the cover plate 18 as well. Advantageously, a surface of the base body 12, in FIG. 3 shown to be at the bottom, may be coated to prevent intrusion of liquid or moisture from the interior of the cup 16 into the paper material of the base body 12.

The illustration of FIG. 4 shows multiple stacked covers 10 according to FIG. 1, and FIG. 5 shows a sectional view of multiple stacked covers 10.

As is apparent, a radially interior bottom side of the bead 22 of the cover 10 sitting on top rests on the ring roll 24 of the cover 10 sitting in the middle, and a radially interior portion of the cover 10 sitting on top below the bead 22 rests on the exterior of the reinforcement ring 14 of the cover 10 sitting in the middle. Thus, the covers 10 are, on the one hand, securely stacked one upon the other and are prevented from shifting to one side. In addition, the bead 22 provides for the feature that the covers 10 in the stacked condition not getting jammed into another, since the bead 22 actually prevents that the covers 10 slide further into another than illustrated in FIG. 5. Even numerous covers 10 stacked into another may be easily separated, due to that feature.

Figure 6:
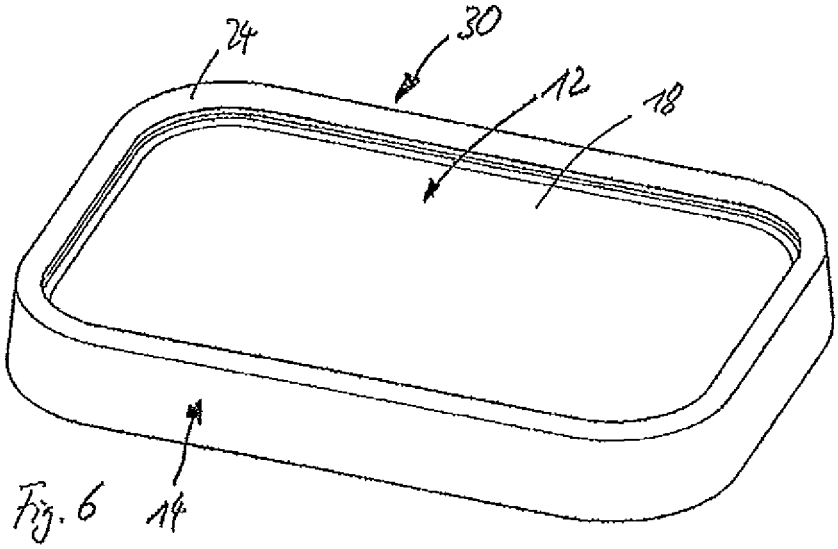
FIG. 6 shows an oblique view from above of another cover according to the invention.
Figure 7:
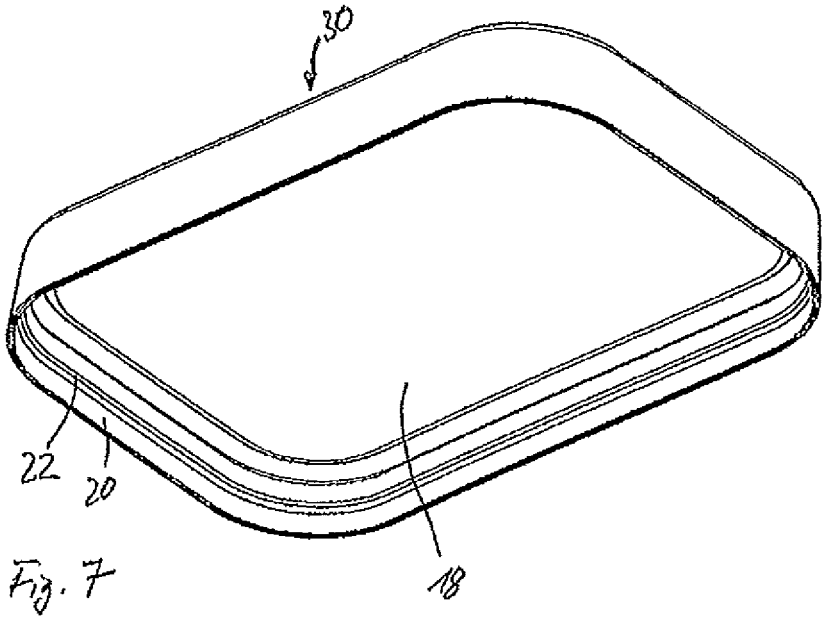
FIG. 7 shows an oblique view from below of the cover of FIG. 6.

The illustration of FIG. 6 shows a cover 30 according to the invention according to another embodiment of the invention, wherein the cover 30 has a rectangular basic shape of rounded corners. Said cover 30 is generally similar to the cover 10 as described with reference to FIGS. 1 to 5, and has in particular a base body 12 including a planar cover plate 18, and a cover collar 20 extending downwards from the cover plate 18. Said cover collar 20 is, refer to FIG. 7, provided with a radially inwards extending circumferential bead 22. A reinforcement ring 14 is placed on the exterior of the base body 12, said ring being provided with a circumferential ring roll 24 on the upper end thereof. Except for the rectangular basic shape, said cover 30 is thus identical to the cover 10 of FIGS. 1 to 5.

Figure 8:
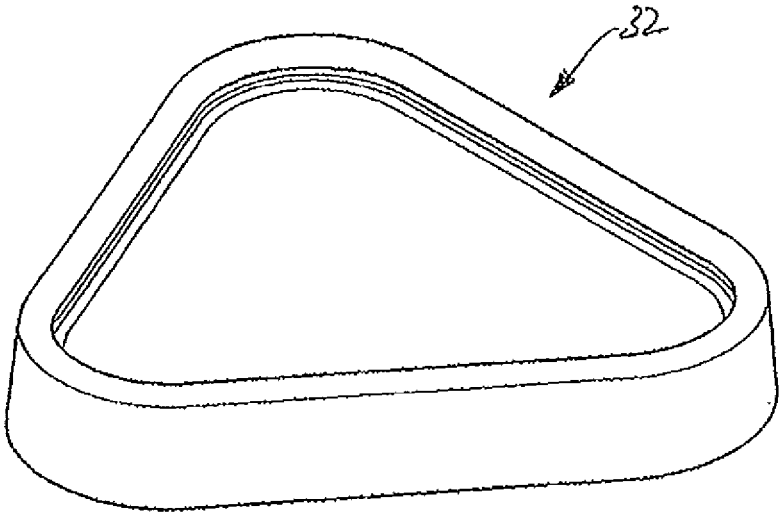
FIG. 8 shows an oblique view from above of another cover according to the invention.
Figure 9:
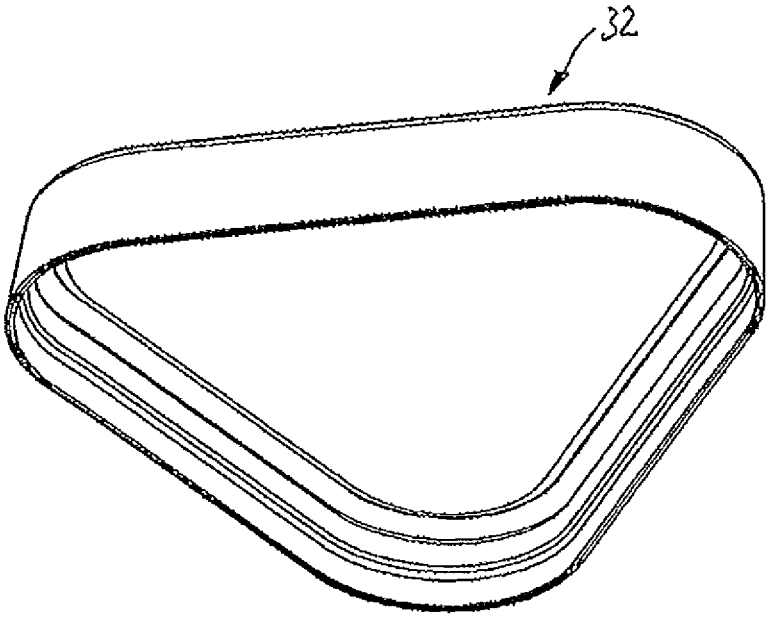
FIG. 9 shows an oblique view from below of the cover of FIG. 8.

The illustration of FIG. 8 shows a cover 32 according to the invention according to another embodiment of the invention. The cover 32 is identical to the cover 10 as described with reference to FIGS. 1 to 5, except for a triangular basic shape and rounded corners. FIG. 9 shows the cover 32 of FIG. 8 in an oblique view from below.

Figure 10:
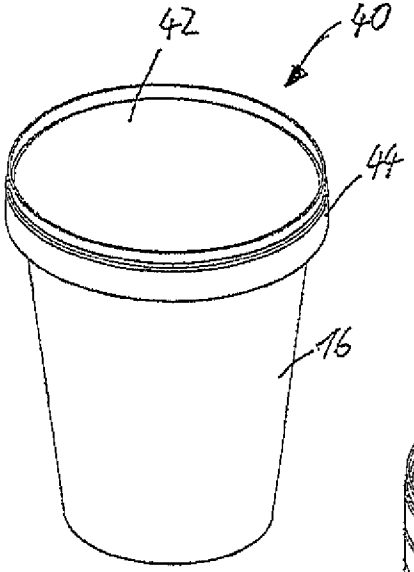
FIG. 10 shows a view of a cup closed by a cover according to the invention according to another embodiment.
Figure 13:
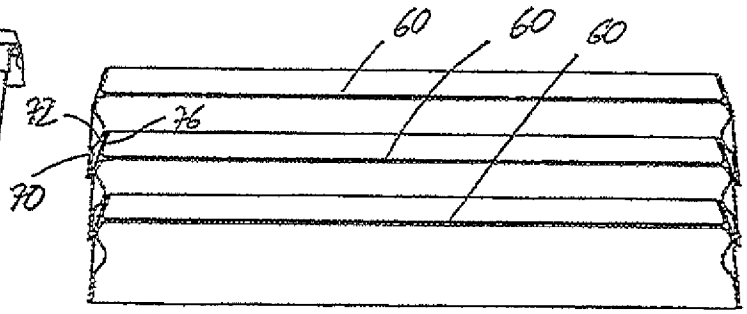

The illustration of FIG. 10 shows a cover 40 including a base body 42 and a reinforcement ring 44. The cover 40 is placed onto the cup 16.

Figure 12:
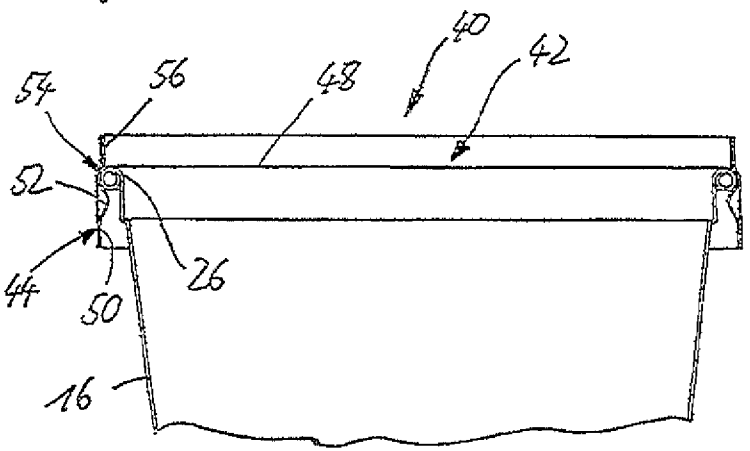
FIG. 12 shows an enlarged detail of the sectional view of FIG. 11.
Figure 11:
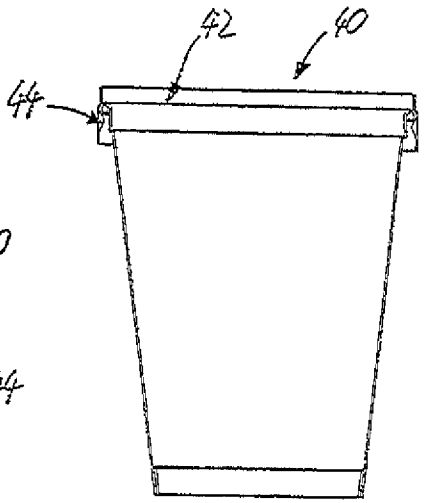
FIG. 11 shows a sectional view of the cup and cover of FIG. 10.

In the sectional view of FIG. 11 and FIG. 12, the structure of the multipart cover 40 made of paper material can be seen in more detail. The base body 42 has a planar cover plate 48 and a cover collar 50 projecting therefrom, said cover collar extending over the entire periphery of the cover plate 48 and disposed approximately perpendicular to the cover plate 48. The base body 42 is produced from a one-piece, circular paper cut-out by deep drawing, and initially has a bowl shape with straight side walls, formed by the planar cover plate 48 and the cover collar 50. Then, a bead 52 is integrally shaped into the cover collar 50 extending radially inwards and having essentially the same shape as the bead 22 of cover 10 in FIGS. 1 to 5. Said bead 2252 is configured to be circumferential and has a constant distance to the cover plate 48. A transitional region 54 between the bead 52 and the cover plate 48 is formed in the shape of a circle segment, in the cross section of FIG. 12, and thereby may receive the lip rim 26 of the cup 16 and provide for a leak-tight closure and secure hold of the cover 40 on the cup 16. As mentioned, the base body 42 is produced from a one-piece paper cut-out such that the base body 42 does not include an overlapping of two or more paper layers, and thereby may rest planar against the lip rim 26.

The reinforcement ring 44 is placed around the base body 42 and rests on a radially exterior periphery of the cover collar 50. Therein, the reinforcement ring 44 rests above and below the bead 52 on the cover collar 50, see FIG. 12, and thereby stabilizes the bead 52 as well. This applies in particular in case that the reinforcement ring 44 is connected to the cover collar 50 above and below the bead 52 by material engagement, for example by adhesive bonding or sealing.

Figure 14:
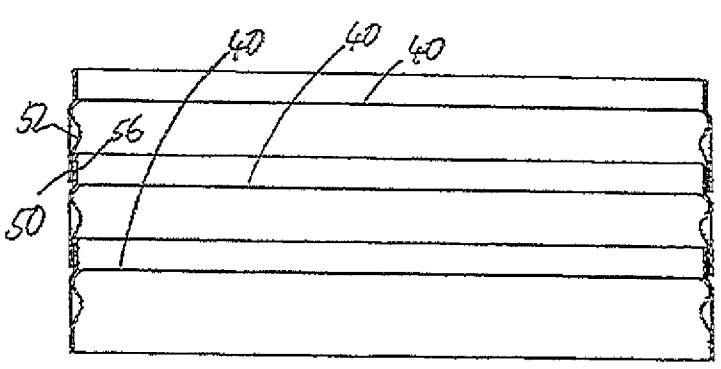
FIG. 14 shows a sectional view of the stacked covers of FIG. 13.
Figure 13:
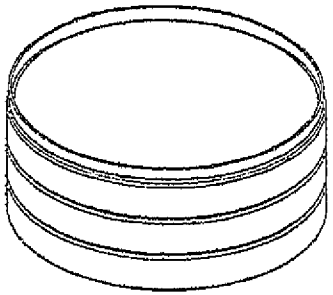
FIG. 13 shows multiple covers according to the invention of FIG. 10 in a stacked condition.

Above the cover plate 48 the cover 40 has a circular cylindrical peripheral skirt 56. The skirt 56 is formed by foldover of the material of the reinforcement ring 44 by 180° and pressing of the foldover. A diameter of the skirt 56 is somewhat smaller than the diameter of the cover collar 44 in a region below the cover plate 48, and also somewhat smaller than the outer diameter of the lip rim 26. The outer diameter of the skirt 56 is to a minor extent smaller or equal to an inner diameter of the cover collar 50 in a region below the bead 52. As is visible in FIGS. 13 and 14, multiple covers 40 may thus be stacked one upon the other. Then, an interior side of the cover collar 50 of a respective top cover rests on the exterior of the skirt 56 of the respective lower cover. Thus, multiple covers 40 can be stacked securely. Sliding of multiple covers 40 on top of another and as a consequence jamming of multiple stacked covers 40 is prevented in that a respective lowest rim of an upper cover 40 rests on a step of the respective lower cover 40, said step being formed at a transition between the skirt 56 and the region of the reinforcement ring 44 below the cover plate 48, that is, in a transitional region 54, wherein the outer diameter of the cover 40 is enlarged in the form of a step. Furthermore, the topmost rim of the skirt 56 of the respective lower cover rests on the lower end of a respective bead 52 of the upper cover 40, and thus also prevents that two or more stacked covers slide onto another and thereby get jammed.

Figure 15:
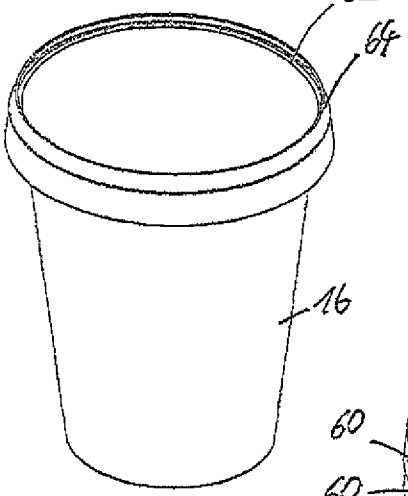
FIG. 15 shows a view of a cup closed by a cover according to the invention according to another embodiment.

The illustration of FIG. 15 shows a cover 60 according to the invention according to another embodiment of the invention placed on the cup 16. The cover 60 comprises a one-piece base body 62 and a reinforcement ring 64 placed around the periphery of the base body 62. The reinforcement ring 64 is sealed onto the planar upper surface of the base body 62 in a region 65.

Figure 17:
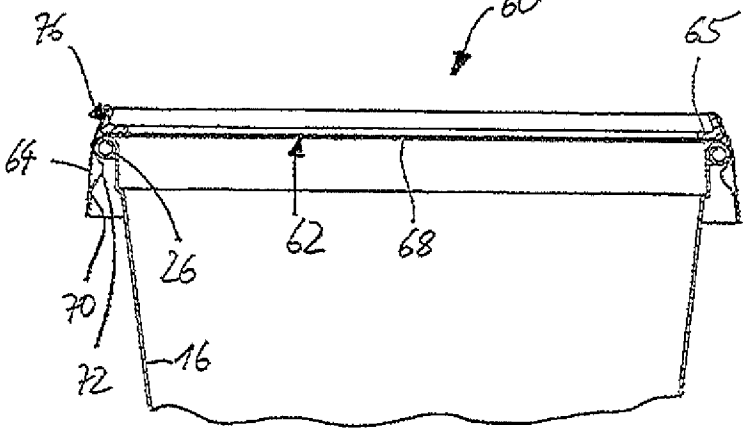
FIG. 17 shows an enlarged detail of FIG. 16.

As can be seen in the sectional view of FIG. 17, the reinforcement ring 64 forms a peripheral step or shoulder by means of the region 65 on the cover top side, with the height of the step being significantly exaggerated in FIG. 17.

The base body 62 is identical to the base body 12 of the cover 10 in FIGS. 1 to 5, and comprises a planar, circular cover plate 68 and a cover collar 70 extending from the cover plate 68. The cover collar 70 is provided with a circumferential and radially inwards extending bead 72. Consequently, the base body 62 has a bowl-type shape, with the cover collar 70 not being arranged in a right angle to the cover plate 68, but including an angle of somewhat more than 90° to the cover plate such that the base body 62 is slightly flaring towards the open end thereof, except for the radially inwards extending bead 72. A transitional region between the bead 72 and the cover plate 68 is in the shape of a circle segment, as viewed in cross section in order to receive the lip rim 26 of the cup 16. Thus, on the one hand, the cover can be securely held on the cup 16 by means of the bead 72 snapping-in behind the lip rim 26, and on the other hand, a tight sealing of the cup 16 is obtained.

The reinforcement ring 64 is placed around the exterior periphery of base body 62 and rests on a radially exterior side of the cover collar 70 above and below the bead 72. In a region above the cover plate 68 the reinforcement ring 64 is in the shape of a truncated cone, with the diameter of the reinforcement ring 64 decreasing towards the top in FIG. 17. Thus, above the cover plate 68, the cover 60 has a bowl-type shape open towards the top. The reinforcement ring 64 is folded over by 180° at the upper edge thereof above the cover plate 68 such that a peripheral skirt 76 in the shape of a truncated cone is formed above the cover plate 68. Adjacent to the skirt the reinforcement ring 64 is folded over and parallel to the upper surface of the cover plate 68, to thereby form the region 65. In the region 65 the reinforcement ring 64 is sealed or bonded to the upper surface of the cover plate 68.

Figure 18:
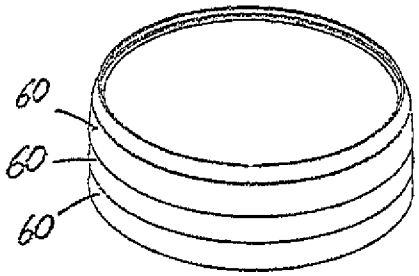
FIG. 18 shows multiple stacked covers according to FIG. 15.

Referring to FIGS. 18 and 19 it is obvious that multiple covers 60 can be stacked. Thereby the skirt 76 tapering towards the top in a truncated cone shape of a respective lower cover 60 comes to be placed within the cover collar 70 of a respective upper cover 60, and sliding of two stacked covers 60 too far onto another is prevented in that the peripheral skirt 76 of a respective lower cover 60 abuts inside the bead 72 of the respective upper cover 60.

The cover 60 is particularly stable due to the peripheral skirt 76 and the region 65 of the reinforcement ring 64 connected to the cover upper surface. As a result, the cover 60 may either be used for very large cups 16, or the cover 60 may be constructed using thinner paper material.

Figure 20:
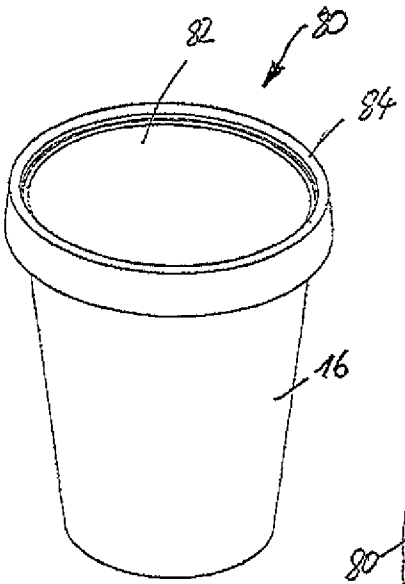
FIG. 20 shows a view of a cup closed by a cover according to the invention according to another embodiment.

The illustration of FIG. 20 shows a cover 80 according to the invention placed onto the cup 16.

The cover 80 is essentially similar to the cover 10 of FIGS. 1 to 5, and therefore merely the differing components will be explained.

The cover 80 comprises a one-piece base body 82 exhibiting minor differences to the base body 12 of cover 10. A reinforcement ring 84 is slid on the base body 82, said ring being identical to the reinforcement ring 14 of cover 10.

Figure 22:
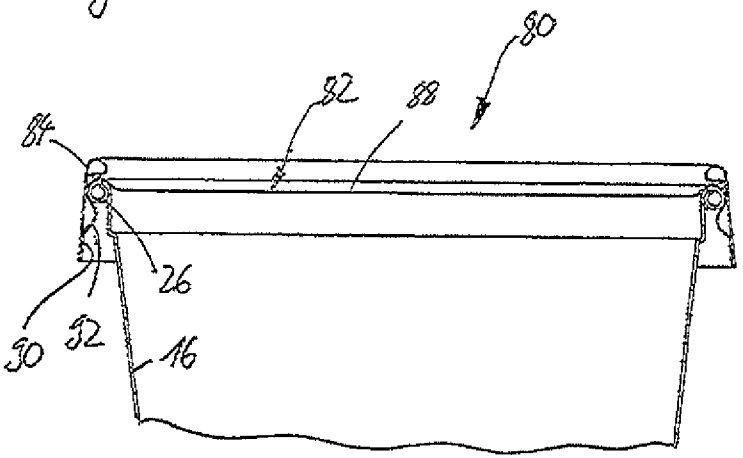
FIG. 22 shows an enlarged detail of FIG. 21.
Figure 21:
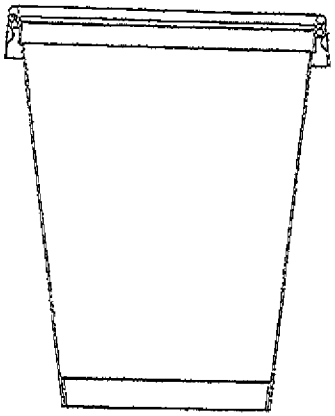
FIG. 21 shows a sectional view of the cup and cover of FIG. 20.

As is evident in particular in FIGS. 21 and 22, the reinforcement ring 84 rests in a region above and below a bead 92 on a cover collar 90 of the base body 82. The reinforcement ring 84 comprises a circumferential roll ring above a cover plate 88 of the base body 82 which rests on an upper surface of the cover plate 88. In contrast to the cover 10 of FIGS. 1 to 5, the cover plate 88 is not planar over the entire diameter, but has a circular, planar, inner portion extending up to the interior side of the lip rim 26 of cup 16. Starting from said inner, planar region towards the exterior, the cover plate 88 adapts, as seen in cross section, to the shape of the lip rim 26, and then passes into the cover collar 90. Thereby, the lip rim 26, as seen in cross section, is received in a groove having a cross section in the shape of a segment of a circle at a transition between the cover plate 88 and the cover collar 90 over an angular range of 180°. Thus, the cover 80 can provide a particularly leak-tight closure of the cup 16. This is due to the fact that the region of the cover collar 90 above the bead 92 and the edge region of the cover plate 88 adjacent thereto have an outward curvature and assume a shape of a segment of a circle, as seen in cross section, matched to the outer diameter of the lip rim 26.

Figure 24:
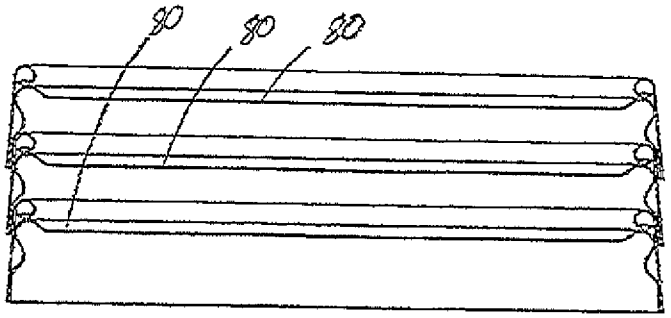
FIG. 24 shows a sectional view of the covers of FIG. 23.
Figure 23:
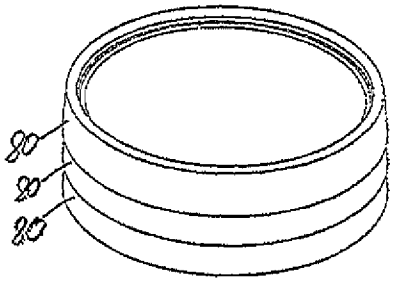
FIG. 23 shows multiple stacked covers according to FIG. 20.

As can be seen in FIG. 23 and FIG. 24, multiple covers 80 can be stacked onto another. The multiple covers 80 rest one on the other in a similar way as described with reference to covers 10 of FIGS. 1 to 5.

Figures 25, 26, 27, 28, 29:
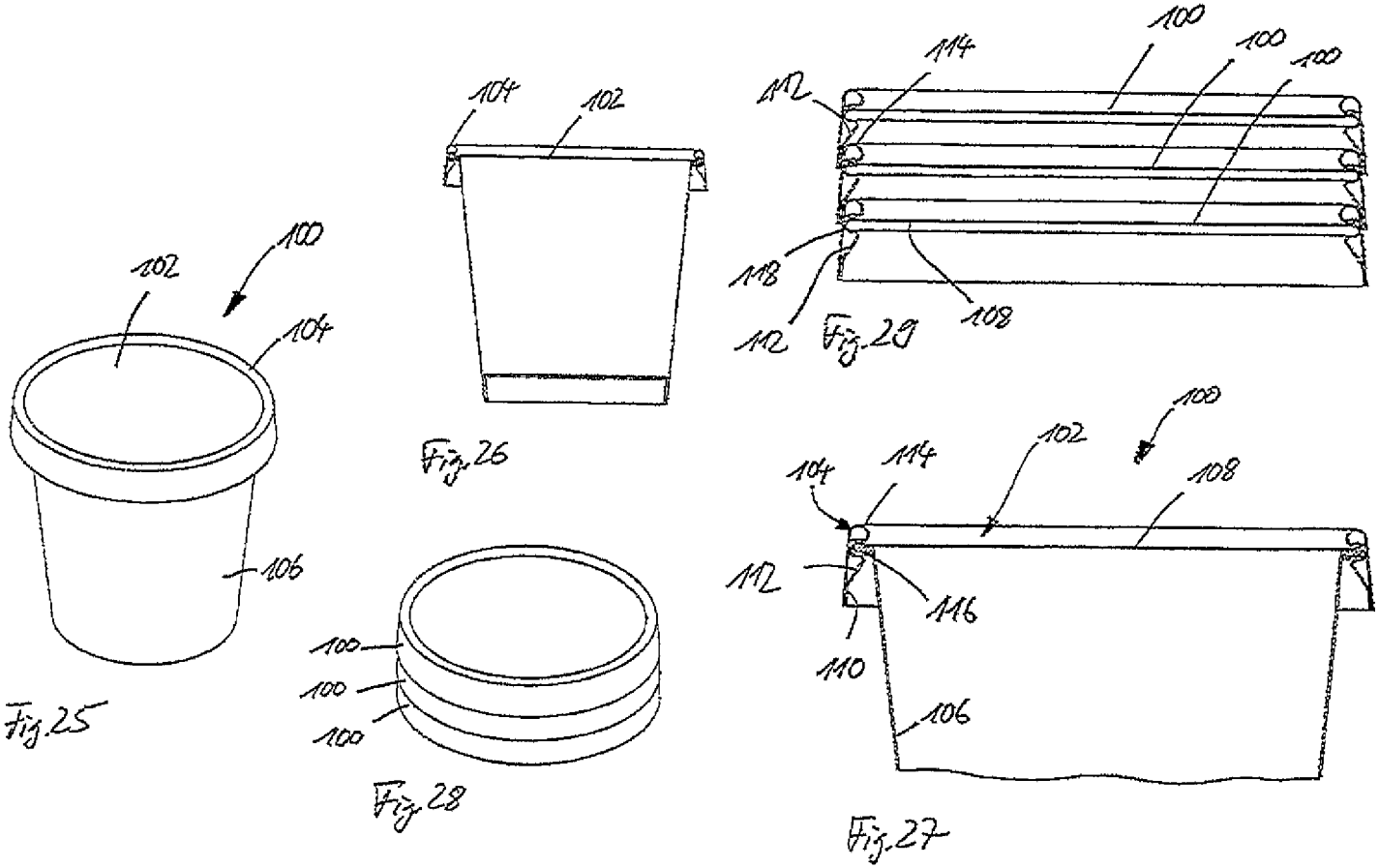
FIG. 25 shows a cup closed by a cover according to the invention according to another embodiment.
FIG. 26 shows a sectional view of the cup and cover of FIG. 25.
FIG. 27 shows an enlarged detail of FIG. 26.
FIG. 28 shows multiple stacked covers according to FIG. 25.
FIG. 29 shows a sectional view of the covers of FIG. 28.

The illustration of FIG. 25 shows a cover 100 having a one-piece base body 102 and a reinforcement ring 104 placed around the periphery of the base body 102. The cover 100 is placed onto a cup 106.

As is evident in particular in FIGS. 26 and 27, the base body 102 includes a planar cover plate 108 and a cover collar 110 extending from the periphery of the cover plate 108. The cover collar 110 is provided with a bead 112 extending radially inwards. The bead 112 has an approximately triangular cross section, as seen in the cross section of FIG. 27. Thus, the bead 112 forms a projection with an upper side thereof facing the cover plate 108 and located nearly parallel to the cover plate 108, and a bottom side thereof extending in an angle of approximately 45° to the cover plate 108. Thus, the bead 112 can snap in behind a flattened lip rim 116 of the cup 106 during placing on the cover 100. The flattened lip rim 116 of the cup 106 is received between the cover plate 108 and the upper surface of the bead 112 facing the cover plate 108 in the placed-on condition of the cover 100. Thus, a particularly secure fixing of the cover 100 on the cover 106 is obtained.

In the top region above the cover plate 108, the reinforcement ring 104 is provided with a ring roll 114 resting on an upper surface of the cover plate 108. In the region below the cover plate 108, the reinforcement ring 104 is outwards enlarging in a cone shape and rests on the cover collar 110 above and below the bead 112.

During sliding on the cover 100, the flattened lip rim 116 is initially approaching the bottom side of the bead 112, whereby the reinforcement ring 104 is then radially enlarged in an inclined plane by the action of the bottom of the bead 112, until the bead 112 is located below the lip rim 116, and the reinforcement ring 104 may then again snap-in radially inwards. A region between the bead 112 and the cover plate 108 is configured to be curved radially outwards to securely receive the flattened lip rim 116 in the placed-on condition of the cover 100.

The cup 106 may be a yoghurt cup, for example, and in addition to the cover 100, a film or aluminum layer is sealed onto the upper side of the flattened lip rim 116 to completely close the content of the cup from the environment. In the opened condition of the cup and after a portion of the contained yoghurt has been consumed, for example, the cup 106 may then be closed reliably using the cover 100.

As can be seen in FIG. 28 and FIG. 29, multiple covers 100 can be stacked onto another. In the stacked condition, the roll ring 114 of a respective lower cover 100 abuts the bottom of the bead 112 of a respective upper cover 100, and thereby prevents that two covers 100 stacked onto another slide too far into another and may thus get jammed.

In the illustration of FIG. 29, the shaping of the region 118 between the bead 112 and the cover plate 108 is visible. Said region 118 is configured to be curved outwards and has the shape of a half oval, in the cross section of FIG. 29, and is thus adapted to the shape of the outer rim of the flattened lip rim 116 of the cup 106.

Figures 30, 31, 32, 33, 34:
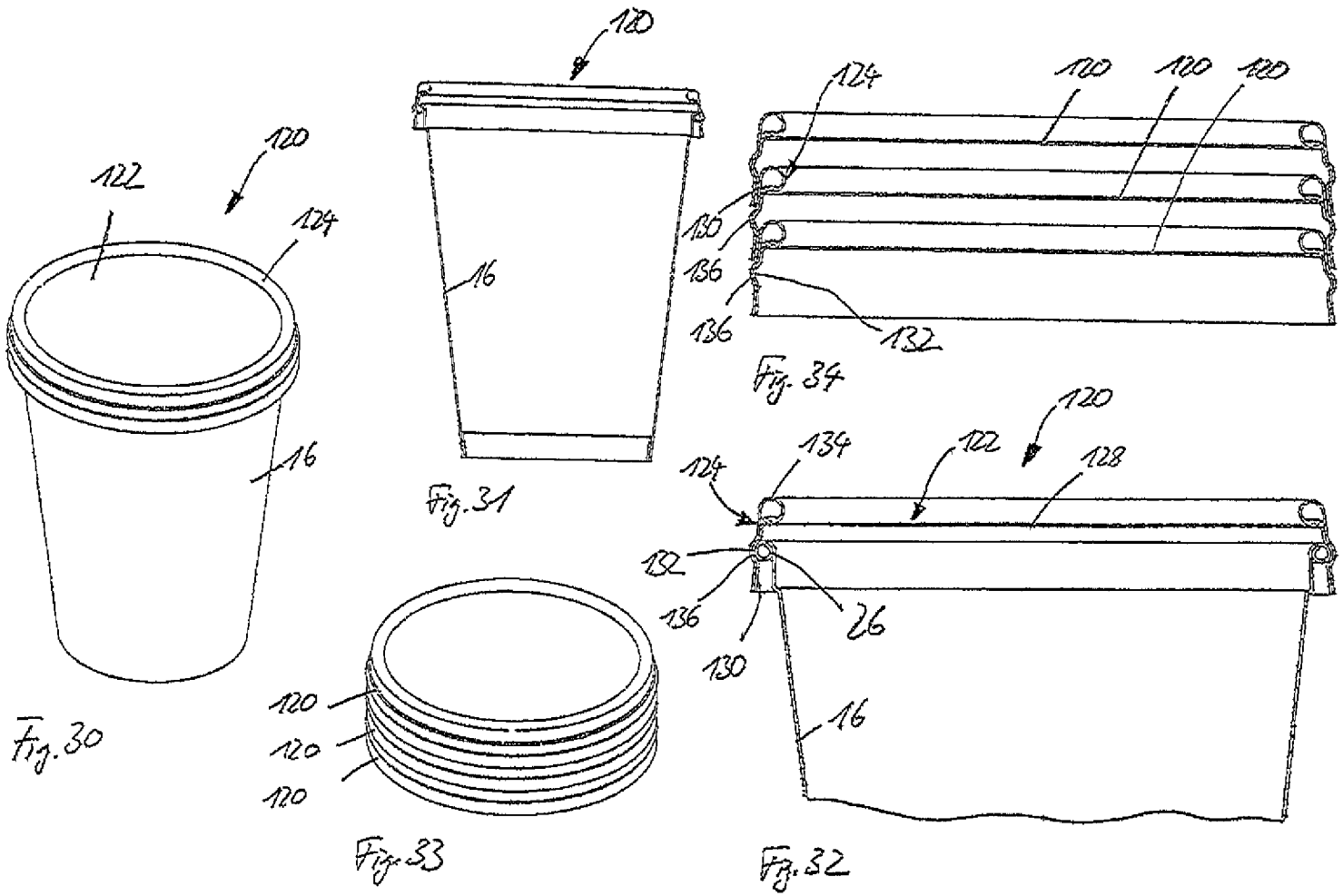
FIG. 30 shows a cup closed by a cover according to the invention according to another embodiment.
FIG. 31 shows a sectional view of the cup and cover of FIG. 30.
FIG. 32 shows an enlarged detail of FIG. 31.
FIG. 33 shows multiple stacked covers according to FIG. 30.
FIG. 34 shows a sectional view of the covers of FIG. 33.
Figure 39:
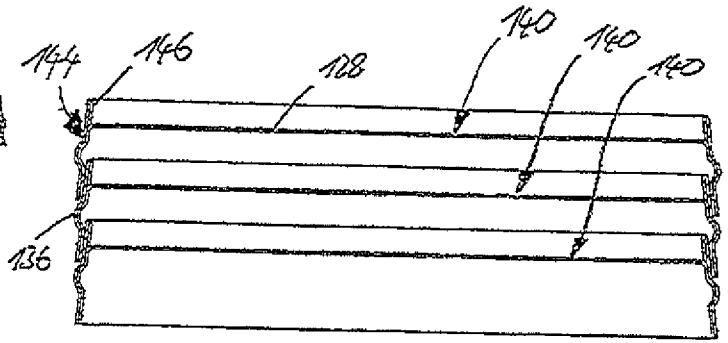
FIG. 39 shows a sectional view of the covers of FIG. 38.
Figure 37:
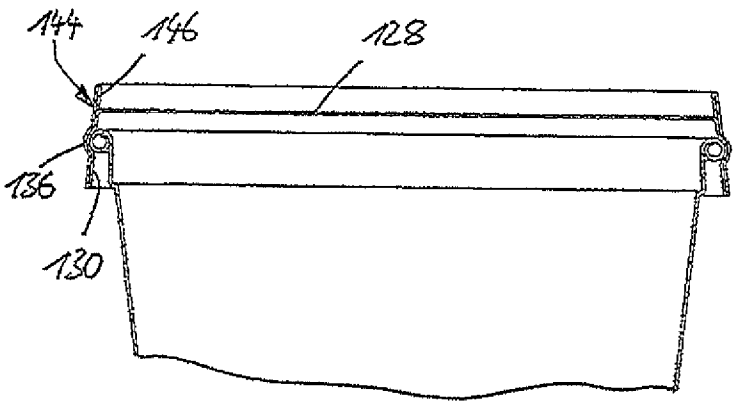
FIG. 37 shows an enlarged detail of FIG. 36.
Figure 36:
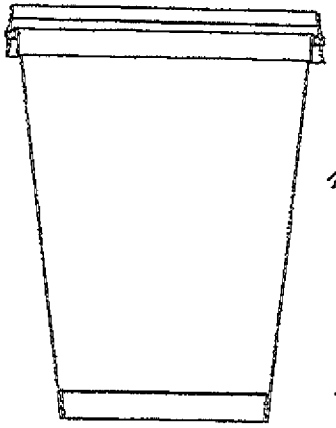
FIG. 36 shows a sectional view of the cup and cover of FIG. 35.
Figure 38:
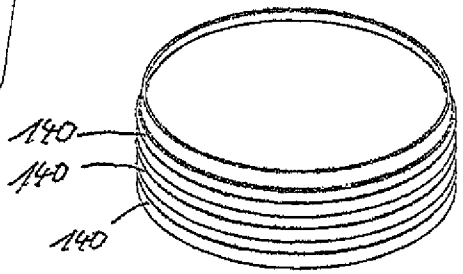
FIG. 38 shows multiple stacked covers according to FIG. 35.

The illustration of FIG. 30 shows a cover 120 according to another embodiment of the invention. The cover 120 is provided with a one-piece base body 122 and a reinforcement ring 124 placed around the periphery of the base body 122. The cover 120 is placed on the cup 16.

As is evident in the sectional view of FIGS. 31 and 32, the base body 122 of the cover 120 comprises a circular, planar cover plate 128 and a cover collar 130 extending from said cover plate. The cover collar 130 includes an angle of somewhat more than 90° to the cover plate 128 such that the base body 122 has a bowl shape open towards the bottom in FIG. 32, and flaring to the open end thereof.

The cover collar 130 is provided with a circumferential bead 132, see FIG. 34, extending radially outwards and having the shape of the segment of a circle, as seen in cross section. The radius of the circle is matched to the outer diameter of the lip rim 26 of the cup 16 such that in the condition of the cover 120 placed-on, see FIGS. 31 and 32, the lip rim is received in the bead 132 with the radially exterior region thereof, and thus the cover 120 is arranged in a defined position on the cup 16. Therein, the bead 132 is disposed at a constant distance to the cover plate 128. Thus, the cover plate 128 is disposed by said distance above the upper edge of the lip rim 26 of the cup 16.

The reinforcement ring 124 has a roll ring 134 above the cover plate 128, resting on an upper surface of the cover plate 128. In a region below the cover plate 128, the reinforcement ring 124 rests planar on an exterior side of the cover collar 130, and thus also follows the extension of the bead 132. Thereby, the reinforcement ring 124 has a radially outwards projecting bead 136 in the region below the cover plate 128. Due to the planar abutment of the reinforcement ring 124 on the cover collar 130 over the entire surface of the cover collar 130, the cover collar 130 is very stable. This may even be further improved in that the reinforcement ring 124 is bonded or sealed in a planar manner to the cover collar 130, for example.

Referring to FIGS. 33 and 34 it is obvious that multiple covers 120 can be stacked one onto the other. In the stacked condition, the lowermost edge of the cover collar 130 of the respective upper cover rests on the upper side of the bead 136 of the reinforcement ring 124 of the respective lower cover 120, and thus prevents that two stacked covers 120 slide too far onto another and get jammed.

Figure 35:
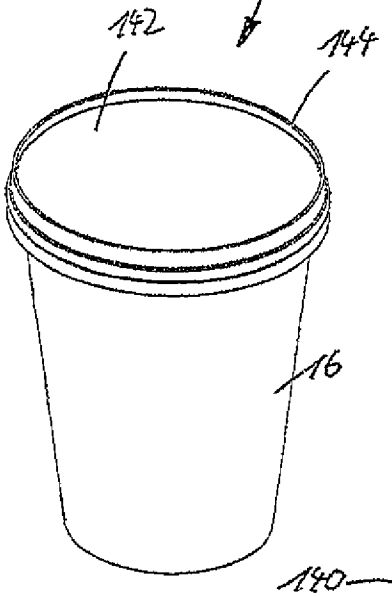
FIG. 35 shows a cup closed by a cover according to the invention according to another embodiment.

The illustration of FIG. 35 shows another cover 140 according to the invention that is placed on the cup 16. The cover 140 is very similar to the cover 120 of FIGS. 30 to 34, and therefore merely the components differing from those of cover 120 will be explained.

The cover 140 comprises a one-piece base body 142 having an identical structure to the base body 122 of the cover 120 of FIGS. 30 to 34. Around the base body 142 is placed a reinforcement ring 144. The reinforcement ring 144 differs from the reinforcement ring 124 of the cover 120 merely in that instead of the roll ring 134 above the cover plate 128 a peripheral skirt 146 is provided. In the region below the cover plate 128, see FIGS. 36 to 39, the reinforcement ring 144 is identical to the reinforcement ring 124 of the cover 120.

The skirt 146 is formed by folding over the region of the reinforcement ring 144 above the cover plate 128 by 180° and subsequent pressing of said foldover. The peripheral skirt 146 has a truncated cone shape tapering towards the top, away from the cover plate 128. When stacking multiple covers 140, see FIGS. 38 and 39, an interior side of the cover collar 130 of a respective upper cover 140 rests on the exterior side of the skirt 146 of the respective lower cover 140. Also, the lowermost edge of the cover collar 130 rests on the upper side of the bead 136 of the reinforcement ring 144 of the respective lower cover 140, and thereby prevents that multiple stacked covers 140 slide too far into another and thus get jammed.

For producing a multipart cover according to the invention, at first a base body including a cover plate and a cover collar is shaped from a one-piece paper cut-out, conveniently by deep drawing of the paper cut-out. Depending on the desired basic shape of the cover, said paper cut-out may have a different shape, for example, circular, rectangular or triangular.

A circumferential bead can be formed in the cover collar of the base body, extending either radially inwards or radially outwards. The shape of the bead may be selected to be such that it either extends radially outwards and is matched to the shape of a lip rim of a cup to be closed. If the bead is extending inwards, the bead is a circumferential projection to snap-in below the lip rim of a cup to be closed upon placing the cover on. A region between the bead and the cover plate may be shaped to be curved radially outwards, and advantageously, the shaping is such that it is matched to the cross-sectional shape of the lip rim of a cup to be closed. Such a lip rim of a cup to be closed can have a circular or even oval shape, as seen in cross section, when the lip rim is flattened.

A reinforcement ring is shaped from a strip-shaped paper cut-out in that the strip-shaped paper cut-out is connected to a ring shape in the vicinity of an overlapping. In the vicinity of the overlapping, the strip-shaped paper cut-out can be bonded by adhesive or sealed. For stiffening, the reinforcement ring can be provided with a ring roll or a peripheral skirt, for example. The reinforcement ring is applied on the cover collar on the radially exterior side of the cover collar, and connected to the cover collar at least sectionally, for example by adhesive bonding, gluing or sealing. For example, the reinforcement ring can be slid onto the base body and then secured thereto.

To produce a particularly stable cover, a reinforcement means in a bowl shape can be provided above the cover plate. A planar bottom of the reinforcement means is then resting on the cover plate of the base body, and a reinforcement collar of the reinforcement means is appropriately connected to the reinforcement ring, by means of a peripheral skirt above the cover plate, for example.

Figures 40, 41, 42, 43, 44:
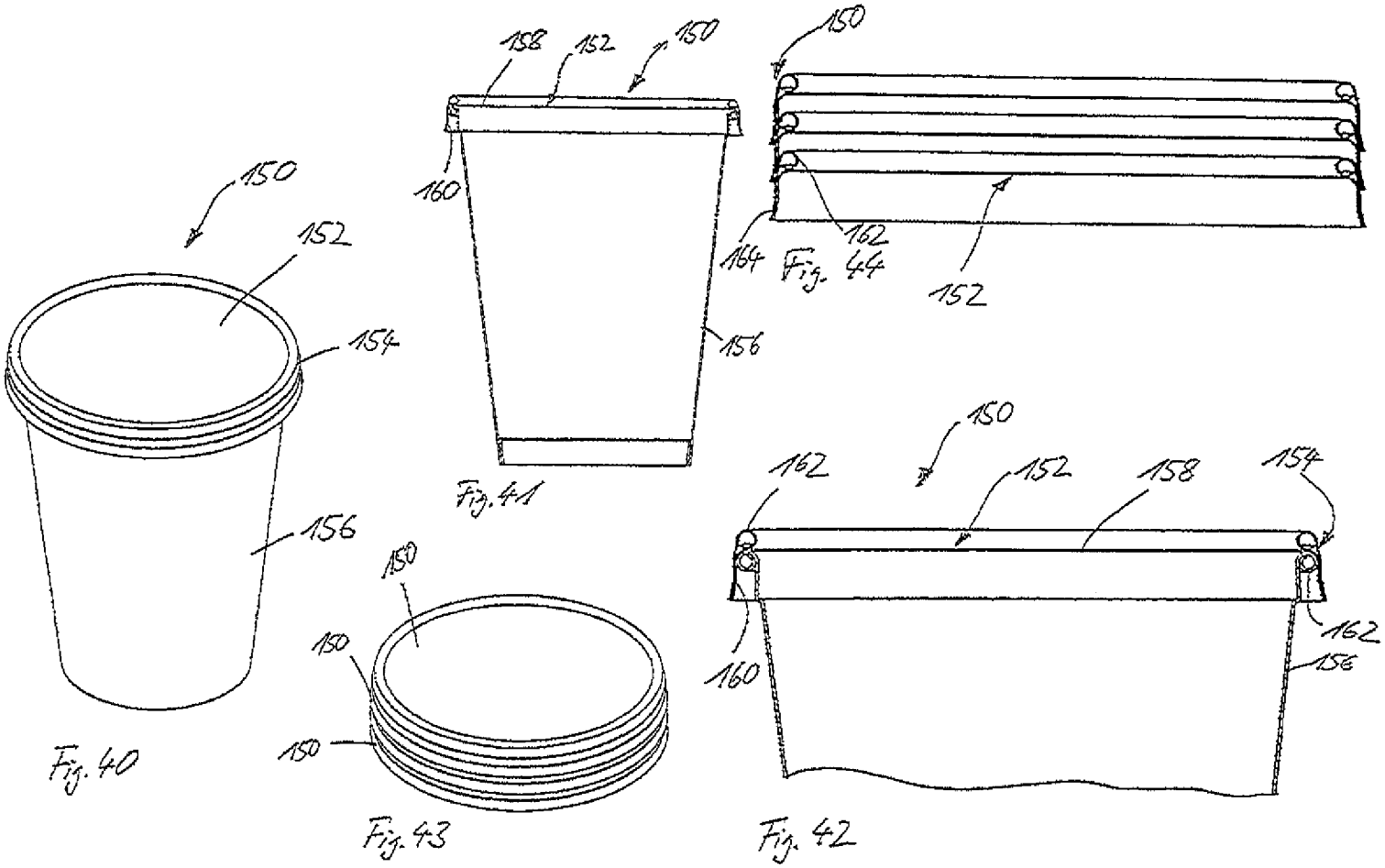
FIG. 40 shows a view of a cup with a cover according to the invention placed thereon according to another embodiment.
FIG. 41 shows a sectional view of the cup and cover of FIG. 40.
FIG. 42 shows an enlarged detail of FIG. 41.
FIG. 43 shows a view of multiple stacked covers.
FIG. 44 shows a sectional view of the stacked covers of FIG. 43.

The illustration of FIG. 40 shows a cover 150 according to the invention according to another embodiment that is placed onto a cup 156. The cover 150 is in a two-piece form and comprises a bowl-shaped base body 152 and a reinforcement ring 154 placed around the rim of the bowl-shaped base body 152.

In the sectional view of FIG. 41 showing the cup 156 with the cover 150 placed thereon, the bowl shape of the base body 152 open at the bottom is visible. The base body 152 includes a cover plate 158 and a circumferential cover collar 160 extending from the periphery of the cover plate 158.

In the illustration of FIG. 42 an enlarged detail of FIG. 41 is shown. The cup 156 has a lip rim 162 at the upper edge thereof. A transition between the cover plate 158 and the cover collar 160 is rounded and matched to the outer radius of the lip rim 162. Thus, the cover 150 with its base body 152 rests tight on the lip rim 162. Since the base body 152 is in one piece, there is no overlapping and thus, said base body can adapt tightly to the lip rim 162 over the entire periphery thereof. Indeed, the lip rim 162 in general has an overlapping, however, said overlapping has but a very small height, since the lip rim is integrally shaped with the truncated cone-type shell, and the overlapping is thereby flattened.

The reinforcement ring 154 is slid over the base body 152 on the exterior, and includes a roll ring 162 resting on the upper surface of the cover plate 158. Adjacent to the roll ring 162 the reinforcement ring 154 extends radially downwards and rests continuously on a radially exterior side of the cover collar 160.

The cover collar 160 and the reinforcement ring 154 have a conical outwards enlargement or flaring on their lower portion in FIG. 42. Thereby, the placing on of the cover 150 onto the cup 156 is facilitated. The cover 150 does not include a bead to engage behind the lip rim 162. Due to the one-piece embodiment of the base body 152, the cover 150 still provides a sufficiently leak-tight closure. Since the cover collar 160 and the reinforcement ring 154 are more than twice as high as the lip rim 162, the cover 150 sits secure on the cup 156, without a bead provided, and thus may be removed easily.

In the illustration of FIG. 43, a total of three stacked covers 150 are shown, and FIG. 44 shows a sectional view through said three stacked covers 150. It is obvious that in each case an enlarged, lower portion 164 rests on the exterior of the respective ring roll 162 of the lower cover 150, with a cone angle of the region 164 and a cone angle of the reinforcement ring 154 in the region downwards adjacent to the roll ring 162 being essentially similar. This is to prevent that the respective upper cover 150 slides too far onto the respective lower cover 150. This is to avoid that even numerous covers 150 stacked one upon the other become blocked and may be separated but with difficulty.

Figures 43, 45, 46, 47, 48:
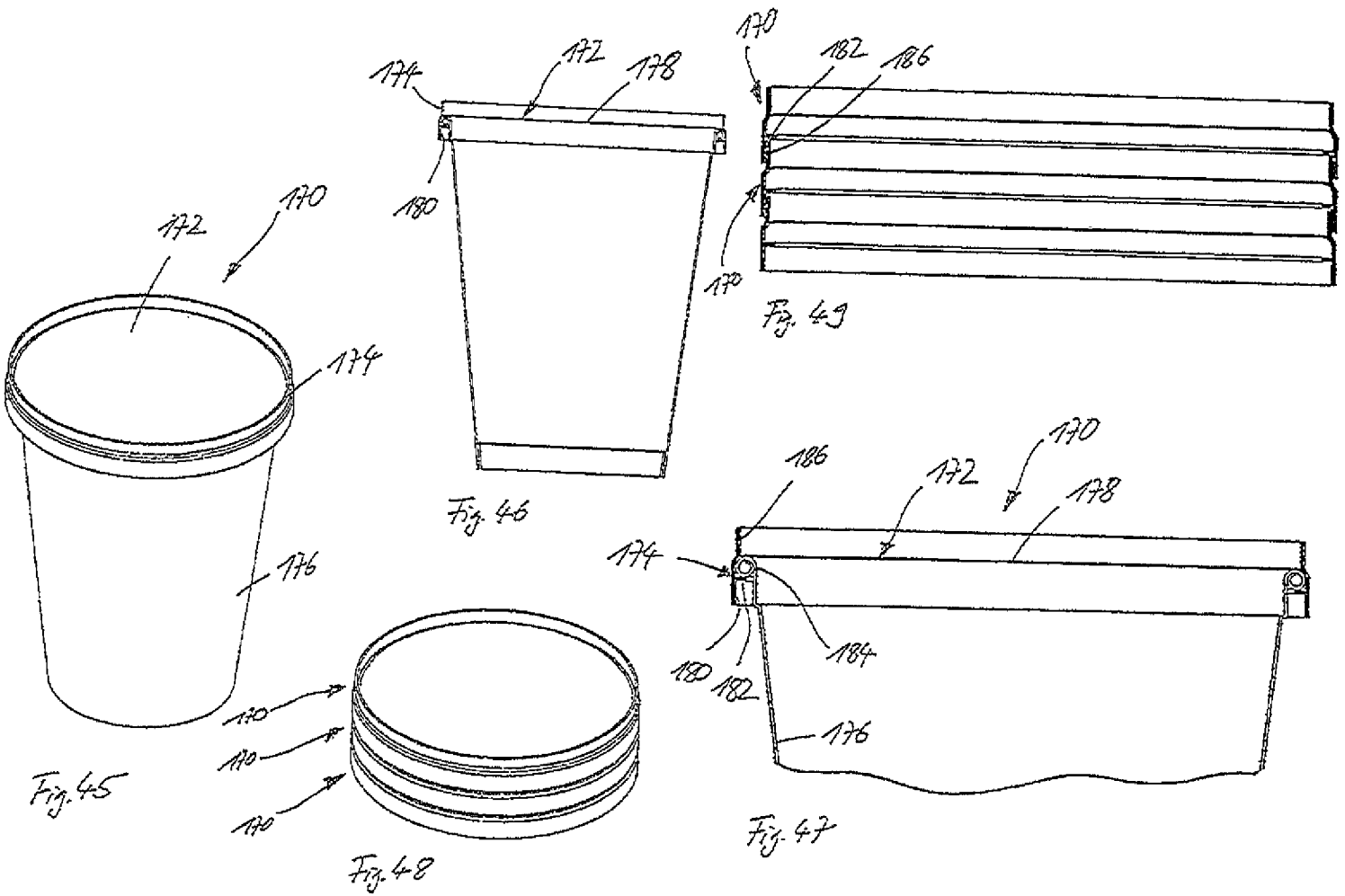
FIG. 45 shows a view of a cup with a cover according to the invention placed thereon according to another embodiment.
FIG. 46 shows a sectional view of the cup and cover of FIG. 45.
FIG. 47 shows an enlarged detail of FIG. 46.
FIG. 48 shows a view of multiple stacked covers.

The illustration of FIG. 45 shows a cover 170 according to the invention in another embodiment of the invention with the cover 170 placed onto a cup 176.

The cover 170 is configured in a two-piece form and has a bowl-shaped base body 172 which comprises a cover plate 178 and a cover collar 180 extending downwards from the periphery of the cover plate, see the sectional view of FIG. 46. A reinforcement ring 174 is placed on the radially exterior periphery of the base body 178 and the cover collar 180, respectively, and connected to the cover collar 180, by means of sealing or adhesive bonding, for example.

The illustration of FIG. 47 shows an enlarged detail of FIG. 46. The cover collar 180 is folded over by 180° at the lower edge thereof, and then, after another bending by 90°, forms a peripheral step or shoulder 182 extending radially inwards. Thereby, an interspace is formed between the cover plate 178 and the step 182, matched to the height of a lip rim 184 of the cup 176. During placing on the cover 170 onto the lip rim 184 of the cup 176, the cover collar 180 including the reinforcement ring 174 is enlarged radially outwards, until the projection 182 snaps-in behind the lip rim 184. Then, the cover plate 178 rests on top of the lip rim 184, and the projection 182 rests on the bottom of the lip rim 184. A transition between the cover collar 180 and the cover plate 178 is configured in a rounded shape and matched to the outer radius of the lip rim 184. Thus, the cover 170 provides a reliable leak-tight closure of the interior of the cup 176. This is also due to the fact that the base body 172 is in one-piece, and thus there is no overlapping in the vicinity of the transition between the cover plate 178 and the cover collar 180.

The reinforcement ring 174 rests planar on an exterior side of the cover collar 180 and is connected to the exterior side of the cover collar 180, for example, by adhesive bonding or sealing on. Above the cover collar 180 the reinforcement ring 174 forms a peripheral, cylindrical skirt 186. The skirt 186 is obtained in that an upper edge of the reinforcement ring 174 is folded over by 180°. An outer diameter of the skirt 186 is insignificantly smaller than an interior diameter of the cover collar 180 in a region below the step 182.

As is evident in the illustrations of FIG. 48 and FIG. 49, the stacking of multiple covers 170 is allowed thereby. During stacking, the cover collar of a respective upper cover 170 slides past the exterior of the skirt 186 of the respective lower cover 170, until the step 182 of the upper cover abuts on the upper rim of the skirt 186 of the lower cover. An end position of the upper cover on the lower cover is defined thereby, and the covers stacked onto another cannot become blocked, but may be readily separated again.

The reinforcement ring can be connected in a region above and below the projection 182 to the cover collar 180, for example by adhesive bonding or sealing on, to stabilize the cover 170 in particular in the region of the step 182.

Figure 16:
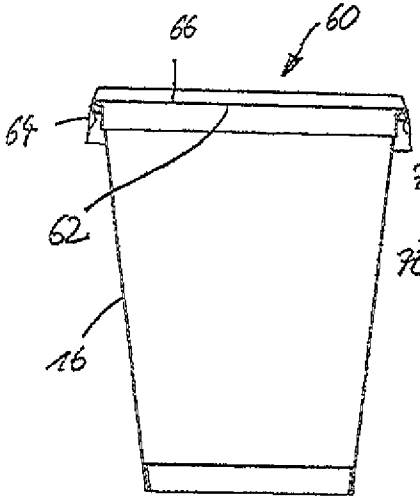
FIG. 16 shows a sectional view of the cup and cover of FIG. 15.

Even when providing a bead on the cover collar, see the embodiment of FIGS. 15 to 17, for example, the reinforcement ring 64 can be connected to the cover collar above the bead 72 and below the bead 72, for example by adhesive bonding or sealing on. Thereby the bead 72 is stabilized.

In all the embodiments of the cover according to the invention, the reinforcement ring and the base body of the cover may be produced from different materials, for example paper or cardboard in different material thickness or quality. For example, the reinforcement ring may have material characteristics, at least on an exterior side thereof, that ensure simple printing on in high quality. A material combination of synthetic material/paper is also conceivable.

The invention claimed is:

1. A multipart cover made of paper material, comprising a base body which includes a cover plate and a circumferential cover collar extending from the cover plate, wherein the cover collar and the cover plate are shaped from a one piece paper material cut-out, wherein the cover collar, in a condition placed onto a container to be closed, surrounds and rests against an upper rim of the container to be closed, and a reinforcement ring which surrounds the cover collar at least sectionally on a radially exterior side of the cover collar, wherein the cover collar includes at least one bead encircling the cover collar in a circumferential direction, wherein the bead is disposed at a constant distance to the cover plate as viewed in an elevation direction, wherein the bead extends radially inwards relative to a portion of the cover collar, wherein a space is located between the cover collar and the reinforcement ring at the bead, wherein the reinforcement ring is connected to the cover collar by adhesive bonding or sealing above and below the bead extending along a periphery of the reinforcement ring, and wherein the reinforcement ring is exclusively arranged on the radially exterior side of the cover collar.

2. The multipart cover according to claim 1, wherein a portion of the cover plate, immediately adjacent to the cover collar, is curved outwards.

3. The multipart cover according to claim 2, wherein the cover collar is configured as a truncated cone.

4. The multipart cover according to claim 1, wherein the base body is configured in one piece and has a constant material thickness.

5. The multipart cover according to claim 4, wherein the base body is produced from a planar cut-out by folding the cover collar from the cover plate.

6. The multipart cover according to claim 1, wherein a portion of the reinforcement ring disposed above the cover plate has an outer diameter that is smaller than an inner diameter of the cover collar below the bead and an inner diameter of the bead is smaller than an outer diameter of the reinforcement ring above the cover plate.

7. The multipart cover according to claim 1, wherein the reinforcement ring on an upper surface of the cover plate is provided with a roll ring extending over a periphery of the cover and having an essentially circular cross section.

8. The multipart cover according to claim 7, wherein the roll ring rests on the upper surface of the cover plate.

9. The multipart cover according to claim 7, wherein the reinforcement ring on an upper surface of the cover plate is provided with a peripheral skirt.

10. The multipart cover according to claim 9, wherein the reinforcement ring rests planar against a periphery of the cover collar.

11. The multipart cover according to claim 1, wherein the reinforcement ring is provided with a peripheral skirt on an upper surface of the cover plate.

12. The multipart cover according to claim 11, wherein the skirt is cylindrical.

13. The multipart cover according to claim 11, wherein the skirt is in the shape of a truncated cone.

14. A multipart cover made of paper material comprising:

a one piece integral base body having a cover plate and a circumferential cover collar extending from and being connected to the cover plate;

the cover collar surrounding and resting against an upper rim of a container to be closed when placed onto the container to be closed; and a reinforcement ring separate from, abutting and surrounding the cover collar on a radially exterior side of the cover collar;

wherein the cover collar includes at least one bead encircling the cover collar in a circumferential direction, the bead is disposed at a constant distance to the cover plate as viewed in an elevation direction, the bead extends radially inwards relative to a portion of the cover collar, an empty space is located between the cover collar and the reinforcement ring at the bead, and the reinforcement ring is connected to the cover collar by adhesive bonding or sealing above and below the bead extending along a periphery of the reinforcement ring; and wherein the reinforcement ring is exclusively arranged on the radially exterior side of the cover collar.

15. The multipart cover according to claim 14, wherein a portion of the cover plate, immediately adjacent to the cover collar, is curved outwards as viewed in cross section and extends, starting from a transition between the cover collar and cover plate, downwards towards an open side of the cover.

16. The multipart cover according to claim 14, wherein the base body is configured in one piece and has a constant material thickness.

17. The multipart cover according to claim 14, wherein in a downwards direction, in the direction towards the open side of the cover successive to the bead up to a lower rim of the cover, the cover collar is configured as a truncated cone.

18. The multipart cover according to claim 14, wherein a portion of the reinforcement ring disposed above the cover plate has an outer diameter that is smaller than an inner diameter of the cover collar below the bead and an inner diameter of the bead is smaller than an outer diameter of the reinforcement ring above the cover plate.

19. The multipart cover according to claim 14, wherein the reinforcement ring on an upper surface of the cover plate is provided with a roll ring extending over a periphery of the cover and having an essentially circular cross section.

20. A cup assembly comprising:

a multipart cover made of paper material comprising a monolithic integral base body and a reinforcement ring;

the monolithic integral base body including a cover plate and a circumferential cover collar extending from and being connected to the cover plate;

the reinforcement ring being separate from, abutting and surrounding the cover collar on a radially exterior side of the cover collar; and a container having an upper rim;

the cover collar surrounding and resting on the upper rim of the container to close the container;

wherein the cover collar includes at least one bead encircling the cover collar in a circumferential direction, the bead is disposed at a constant distance to the cover plate as viewed in an elevation direction, the bead extends radially inwards relative to a portion of the cover collar, an empty space is located between the cover collar and the reinforcement ring at the bead, and the reinforcement ring is connected to the cover collar by adhesive bonding or sealing above and below the bead extending along a periphery of the reinforcement ring; and wherein the reinforcement ring is exclusively arranged on the radially exterior side of the cover collar.

* * * * *